US007157650B2

(12) United States Patent
Rochon

(10) Patent No.: US 7,157,650 B2
(45) Date of Patent: Jan. 2, 2007

(54) ELECTRICAL SWITCH DEVICE WITH LATERAL ACTIVATION

(75) Inventor: Sylvain Rochon, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/363,814

(22) Filed: Feb. 28, 2006

(65) Prior Publication Data

US 2006/0185971 A1 Aug. 24, 2006

Related U.S. Application Data

(63) Continuation-in-part of application No. PCT/IB2004/002898, filed on Sep. 7, 2004.

(30) Foreign Application Priority Data

Sep. 9, 2003 (FR) ..... 0310616

(51) Int. Cl.
*H01H 5/30* (2006.01)

(52) U.S. Cl. ..... 200/1 B; 200/406

(58) Field of Classification Search ..... 200/1 B, 200/406, 516, 533, 534, 550, 551
See application file for complete search history.

(56) References Cited

U.S. PATENT DOCUMENTS

| | | | | |
|---|---|---|---|---|
| 4,359,614 A | | 11/1982 | Green et al. | |
| 4,412,113 A | * | 10/1983 | Mitsugi et al. | 200/406 |
| 4,659,881 A | | 4/1987 | Dowe | |
| 5,313,027 A | | 5/1994 | Inoue et al. | |
| 5,660,272 A | * | 8/1997 | Janniere et al. | 200/517 |
| 5,898,147 A | * | 4/1999 | Domzalski et al. | 200/1 B |
| 6,495,783 B1 | * | 12/2002 | Rochon et al. | 200/406 |
| 6,639,159 B1 | * | 10/2003 | Anzai | 200/1 B |
| 6,747,218 B1 | * | 6/2004 | Huseman et al. | 200/1 B |
| 6,756,554 B1 | * | 6/2004 | Hu | 200/406 |
| 6,815,628 B1 | * | 11/2004 | Okita et al. | 200/406 |
| 6,936,777 B1 | * | 8/2005 | Kawakubo | 200/1 B |
| 6,995,324 B1 | * | 2/2006 | Asada | 200/1 B |
| 7,022,928 B1 | * | 4/2006 | Watanabe et al. | 200/406 |
| 2002/0166754 A1 | | 11/2002 | Ohba et al. | |

FOREIGN PATENT DOCUMENTS

| | | |
|---|---|---|
| EP | 0 751 542 A1 | 1/1997 |
| EP | 1 113 472 A1 | 7/2001 |

* cited by examiner

*Primary Examiner*—Michael A. Friedhofer
(74) *Attorney, Agent, or Firm*—Peter Van Winkle

(57) ABSTRACT

A casing (1); a first conductive track (31) and a second conductive track (27); a first conductive dome (3) which is resiliently deformable so as to be able to pass to a configuration, in which it forms an electrical contact between the first track (31) and second track (27); and an activation device comprising an operation element (9) which is mounted in the casing so as to slide in an orthogonal manner (X) relative to the axis of deformation (Z). It further comprises: a third conductive track (34); and a second conductive dome (5) which is superimposed on the first (3) and which is resiliently deformable so as to be able to pass, under the action of an activation pressure, successively from a rest configuration, in which it is in electrical contact only with the third track (34), to a configuration of partial deformation, in which it forms an electrical contact with the first dome (3), and to a configuration of maximum deformation which corresponds to the configuration of maximum deformation of the first dome (3). Use in a release device for a camera.

9 Claims, 2 Drawing Sheets

ELECTRICAL SWITCH DEVICE WITH LATERAL ACTIVATION

CROSS-REFERENCE

This is a continuation-in-part of PCT application PCT/IB2004/002898 filed 7 Sep. 2004, which designates the US and which claimed priority from French application 0310616 filed 9 Sep. 2003.

BACKGROUND OF THE INVENTION

The present invention relates to an electrical switch device comprising:

a casing having a base;

a first and a second conductive track which are fixed to the inner side of the casing and which are electrically insulated from each other;

a first conductive dome which is supported on the base of the casing with a permanent contact being formed with the first track, the first dome being resiliently deformable so as to be able to pass, under the action of an activation pressure along a deformation axis, from a rest configuration, in which it is in electrical contact only with the first track, to a configuration of maximum deformation, in which it forms an electrical contact with the second track so that the first and second tracks are electrically connected; and an activation device which comprises an operation element which is mounted in the casing so as to slide in an orthogonal manner relative to the axis of deformation, and a movement transformation element which is suitable for applying an activation pressure along the axis of deformation in response to a displacement of the operation element.

A switch of this type has, for example, been described in the French patent application published under the number 2 803 428 in the name of the same applicant.

A device of this type can allow a change from a first to a second state of commutation by means of a lateral activation movement. The term "lateral" activation is understood to be a pressure, for example, from a user, which is applied in a direction which is substantially orthogonal relative to the plane of the conductive tracks which are to be commutated, or in a direction which is orthogonal relative to the main direction of deformation of the resilient commutation elements. For specific devices, switches with lateral activation are preferable from the point of view of the general size of the device and the ease of operation.

A significant problem in switches with lateral activation of the type mentioned above consists in that they are intended to be able to assume only two states of commutation, corresponding to two position ranges of the activation element along the sliding axis thereof.

There is a requirement for switches with lateral activation having three states of commutation, for example, for use in automatic cameras. In this type of device, the activation of a push-button over a first path brings about automatic updating, and the activation of the push-button over a supplementary path brings about the release.

A significant object of the invention is to provide a switch device with lateral activation having three states of commutation, without significantly increasing the size of the device.

SUMMARY OF THE INVENTION

To this end, an electrical switch device according to the invention comprises:

a third conductive track which is fixed to the inner side of the casing and which is insulated from the first and second tracks; and a second conductive dome which is superimposed on the first and which is supported on the base of the casing with a permanent contact being formed with the third track, the second dome being resiliently deformable so as to be able to pass, under the action of an activation pressure applied by the activation device, successively from a rest configuration, in which it is in electrical contact only with the third track, to a configuration of partial deformation, in which it forms an electrical contact with the first dome whilst the first dome is not in contact with the second track, and to a configuration of maximum deformation which corresponds to the configuration of maximum deformation of the first dome and in which it remains in electrical contact with the first dome, so that the switch device can selectively assume three states of commutation in accordance with the position of the operation element.

According to other advantageous features of the invention, taken individually or in combination:

the first dome has a peripheral portion which defines the region of contact with the first track, and a central portion which defines the region of contact with the second track;

the second dome has a peripheral portion which defines the region of contact with the third track, and a central portion which defines the region of contact with the first dome;

a hole is arranged in the central portion of the second dome; and the device comprises a flexible and insulating sealing membrane which is interposed between the transformation element and the second dome.

The invention also relates to the use of a switch device as previously described in order to produce a release device for a camera.

One particular embodiment of the invention will now be described with reference to the appended drawings, in which:

The novel features of the invention are set forth with particularity in the appended claims. The invention will be best understood from the following description when read in conjunction with the accompanying drawings.

DESCRIPTION OF THE PREFERRED EMBODIMENT

Figure 1:
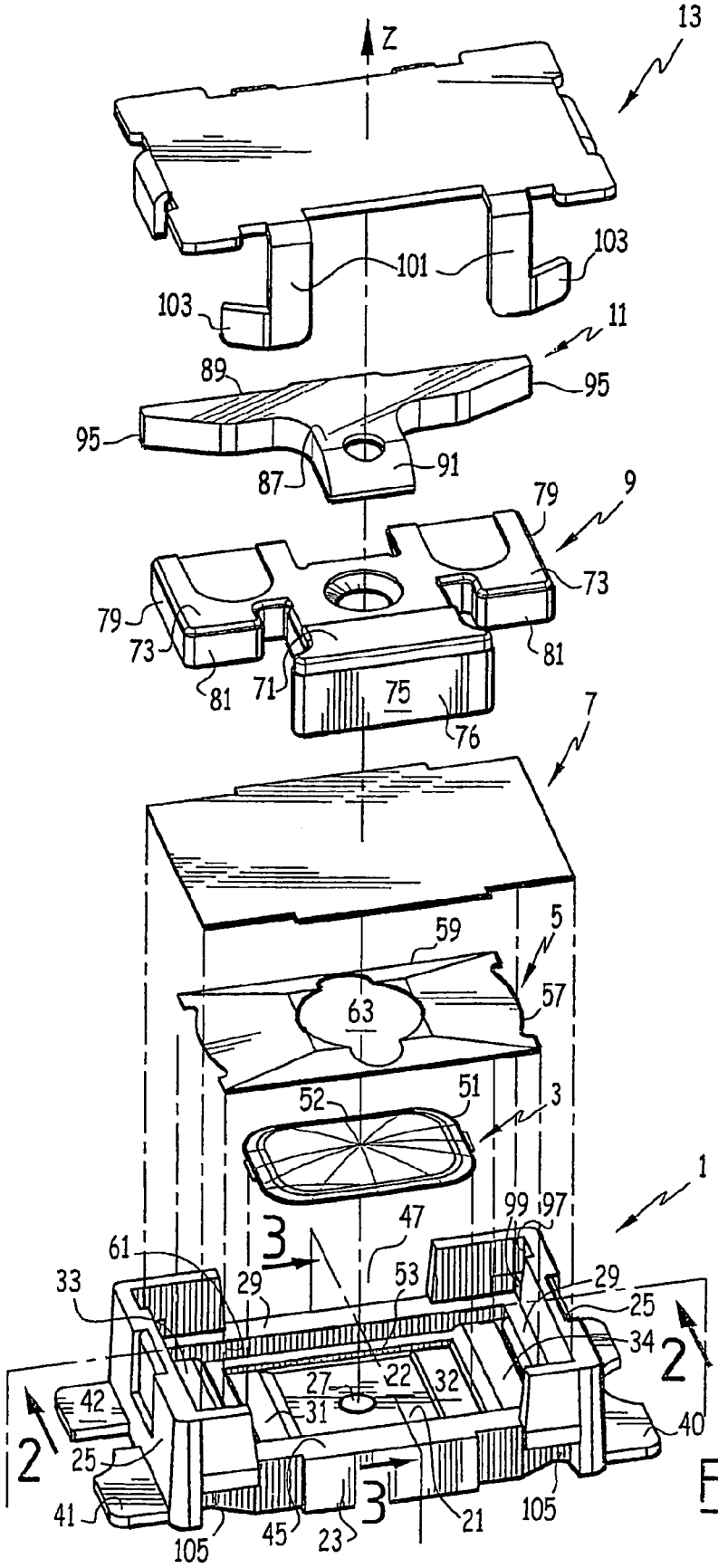
FIG. 1 is an exploded perspective view of an electrical switch device according to the invention.

FIG. 1 is an exploded view of a switch device or switch according to the invention, along axis Z—Z which will be assumed to be vertical for the convenience of the description.

The device substantially comprises:

a casing 1 which forms a base plate, a first dome 3 which is electrically conductive and resiliently deformable, a second dome 5 which is electrically conductive and resiliently deformable, an insulating membrane 7, an operation element 9.

a movement transformation element 11, and a closing plate 13.

Figure 2:
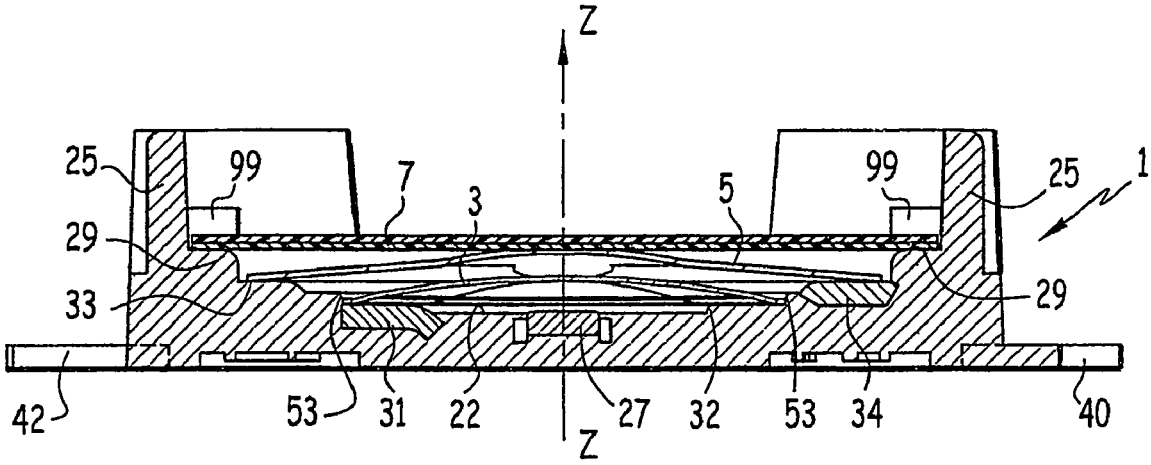
FIG. 2 is a sectioned view in direction 2—2, in a vertical center plane, of the casing, the domes and the insulating membrane illustrated in FIG. 1.

With reference to FIGS. 1 and 2, the structure of the casing 1 will now be described in particular.

The casing 1 is formed by a hollow body which is of generally parallelepipedal form and which has a base 21 and substantially vertical lateral walls 23, 25 which together delimit a housing which is intended to receive the conductive domes 3, 5, the membrane 7, the operation element 9 and the movement transformation element 11. These are held in the housing by means of the closing plate 13 when the switch is in the assembled position.

The base 21 has a base surface 22 which is flat and substantially rectangular.

At the center of the base surface 22, a cylindrical conductive contact element 27 vertically protrudes from the base surface.

The casing 1 has a horizontal peripheral edge 29 which defines a support surface for the peripheral edges of the insulating membrane 7 and which is raised relative to the base surface 22.

When viewing the plane in FIG. 2 which extends parallel with the longest side of the rectangular base of the casing 1, it will be noted that the casing has a stepped internal structure having two intermediate support planes between the central portion which is delimited by the base surface 22 and the peripheral edge 29.

Prom the base surface 22 and in the direction of the two shortest sides of the peripheral edge 29 that are adjacent to the lateral walls 25, the base 21 extends in a stepped manner with two horizontal intermediate support planes substantially being defined which are vertically offset relative to each other and relative to the surface of the peripheral edge 29.

The first intermediate support plane is delimited by two parallel strips 31, 32 which extend at one side and the other of the contact element 27 in a substantially symmetrical manner relative to the vertical center plane which extends through the conductive contact element 27 and the centers of the long sides of the rectangle defined by the peripheral edge 29. This support plane is located above the upper surface of the conductive contact element 27 and below the support plane defined by the peripheral edge 29.

The first strip 31 of this pair is a conductive track, whilst the second strip 32 is an insulating strip.

The second intermediate support plane extends above the first intermediate support plane and below the support plane defined by the peripheral support edges 29. This second intermediate support plane is delimited by two strips 33, 34 which are parallel with the strips 31, 32 which also extend in a substantially symmetrical manner. In the radial direction, these strips 33, 34 extend between the strips 31, 32 and the lateral walls 25.

The first 33 of these strips is insulating, whilst the second 34 of these strips is a conductive track.

Conventionally, the base of the casing 21 is defined as the merging of the base surface and the strips 31, 32, 33, 34 which form the intermediate support planes.

Furthermore, the conductive strip 31 is defined as the first conductive track, the contact element 27 as the second conductive track, and the strip 34 as the third conductive track of the switch.

The casing further comprises three horizontal conductive tongues 40, 41, 42 which protrude laterally from the walls 25. The lower surface thereof is substantially co-planar relative to the outer surface of the base of the casing.

The first conductive tongue 40, which protrudes from the casing over the entire width of a first lateral wall 25, can, for example, be electrically connected to the third conductive track 34 which is located at the same side of the vertical center plane parallel with the wall 25.

In the same manner, the second conductive tongue 41, which protrudes from the other lateral wall 25 over part of the width thereof, can be electrically connected to the first conductive track 31 which is located at the same side of the center plane.

Finally, the third conductive tongue 42, which protrudes from the same lateral wall 25 as the second conductive tongue 41 over another part of the width of the wall, can be electrically connected to the central conductive contact element 27, that is to say, the second conductive track.

The lateral walls of the casing 25 extend vertically above the level of the peripheral edge 29 and over the entire width of these walls. The adjacent lateral walls 23 are themselves formed so as to extend, at the sides, at the same level as the walls 25 and to have, in a central region, an upper edge which is aligned with the peripheral edge 29.

Since the casing 1 is open at the upper horizontal face thereof, the lateral walls 23 thus have two respective opposing notches 45, 47 which are upwardly open.

The casing is preferably produced by means of plastics material being over-molded on the electrically conductive parts.

Figure 3:
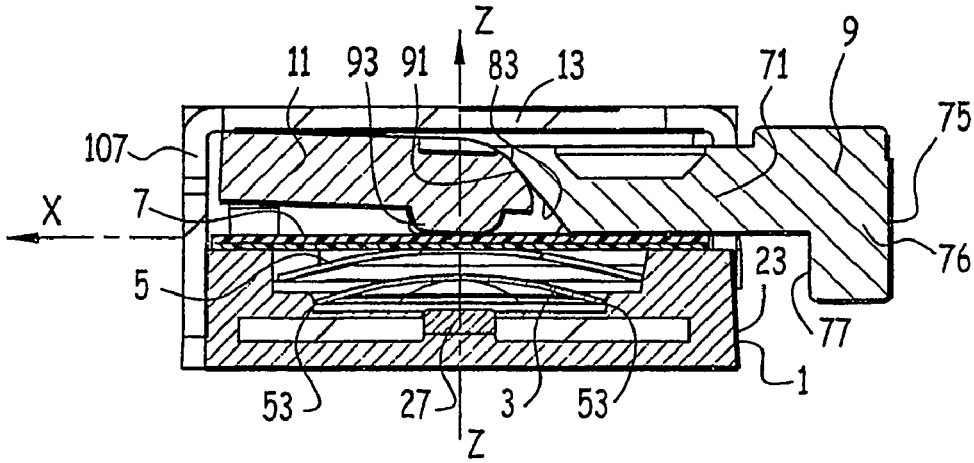
FIG. 3 is a sectioned view in direction 3—3, in a vertical center plane, of the device in FIG. 1, in an assembled configuration.

Reference can now be made to FIGS. 1 to 3.

The first conductive dome 3 is formed by a metal plate which is generally of rectangular form and which has a convexity which is directed upwards when the dome is in the rest position and positioned in the casing. In this position which is known as the operation at rest position and which is illustrated in FIGS. 2 and 3, the dome 3 is centered on the vertical axis Z of the switch. The peripheral edges 51, 52 thereof which correspond to the shortest sides are supported on the strips 31, 32 inside the casing 1. The dome 3 is held in this position owing to the fact that the short sides 51 and long sides 52 thereof are supported on a vertical peripheral shoulder 53 of the casing 1.

It will be appreciated that, in this position, the first dome 3 forms a permanent contact with the first track 31 and that the peak thereof is located perpendicularly to and above the center of the conductive contact element 27.

The second dome 5 is substantially formed by a rectangular metal plate which is larger than the first dome 3 which has a convexity which is directed upwards in the rest position illustrated in FIGS. 2 and 3. In the operating positions thereof, at rest, or in the deformed configurations, the second dome 5 is coaxially superimposed on the first dome 3 and on the conductive contact element 27. The peripheral edge 57 which corresponds to the short side of the rectangle is supported on the strips 33, 34 of the base of the casing 1. In the operating position, the peripheral edges 57 and the peripheral edges 59 which correspond to the long sides of the rectangle abut a second peripheral shoulder 61 of the casing 1, which shoulder extends in a stepped and concentric manner above the peripheral shoulder 53.

The second dome 5 has, at the peak in the central portion thereof, a hole 63 which extends over the main part of the width of the rectangle.

It will be appreciated that, in the operating position in the casing, and in the rest position thereof illustrated in FIGS. 2 and 3, the second dome 5 forms an electrical contact with the third track 34. Conversely, the second dome 5 extends above the first dome 3 with no contact therewith.

The membrane 7 is constituted, in the example illustrated, by two layers of flexible insulating materials. The membrane 7 is of solid form with a substantially rectangular outer contour. It is supported, during operation, on the peripheral edge 19 of the casing 1 and is aligned at the upper surface of the second dome 5, on which it is superimposed.

When the switch is assembled, the membrane 7 forms a sealed separation between the base 21 of the casing and the upper volume of the casing 1, in which the operation element 9 and the movement transformation element 11 are arranged. The membrane also extends in a concentric manner relative to the two domes 3, 5 and the casing 1.

The operation element 9 is a push-button which is mounted so as to be able to slide horizontally in the casing 1 between the lateral walls 23. It is substantially symmetrical relative to the vertical center plane of the assembly containing the sliding direction. The operation element or push-button 9 has a generally T-shaped structure, having a central bar 71 and two lateral blocks 73. The proximal end of the bar 71 which is connected to the blocks 73, is provided with a vertical support surface 75 which is formed by a plate which protrudes from the bar 71 towards the base. The plate also defines a vertical surface 77 for stopping the pushbutton 9 in terms of translation by means of co-operation with the corresponding lateral wall 23 of the casing 1.

As illustrated in FIG. 3, when the switch is in the rest position, the plate 76 protrudes horizontally, along the sliding axis or activation axis X thereof, out of the casing 1 through the notch 45. The stop surface 77 is therefore spaced, along the activation axis X, from the outer face of the lateral wall 23 by a distance which corresponds to the path of the push-button 9.

Whatever the functional state of the switch, the lateral blocks 73 are contained in the casing 1, above the membrane 7, The lateral blocks 73 form parts for guiding the push-button 9 inside the casing 1 by means of the vertical lateral faces 79 thereof which co-operate with the lateral walls 25 of the casing. They also form stop parts which act counter to the push-button 9 being withdrawn from the casing 1 along the activation axis X by means of the proximal vertical faces 81 thereof which are supported on the parts of the corresponding lateral wall 23 that are located at one side and the other of the notch 45.

The distal (or free) end of the central bar 71 is provided with an inclined flat face 83 which is directed towards the base and which forms a cam and which extends between the two lateral blocks 73.

The movement transformation element 11, which is also referred to as an actuator, also has a generally T-shaped structure. When the switch is in the assembled configuration, the actuator 11 is substantially symmetrical relative to the plane of symmetry of the push-button 9. It substantially comprises a central rod 87 which extends, when the switch is in the rest position, substantially horizontally and in such a manner that the free end thereof is directed towards the push-button 9 and a small transverse bar 89 parallel with the lateral walls 23 of the casing 1.

At the free end thereof which defines the proximal end, the central rod 87 has a convex upper surface 91, which has an arcuate cross-section and which forms a cam follower, in permanent contact with the cam surface 83 of the push-button 9.

A "dead-path" for the push-button 9 could also be provided, with a clearance being provided between the cam surface 83 and cam follower surface 91 when the switch is in the rest position.

The central rod 87 further has, at the free end thereof, a stud 93 which protrudes towards the base and which is supported on the membrane 7. This stud 93 is substantially centered on the vertical axis Z.

The free ends 95 of the small transverse bar 89 are received in the vertical recesses 97 which are formed in the two corners of the casing 1 that are defined by the intersections of the lateral walls 25 and the lateral wall 23 opposite the notch 45, through which the push-button 9 protrudes. The free ends 95 are supported at the base of the recesses 97 on respective supporting contact elements 99.

Since the end portions of the small bar 89 are tapered, they are free to pivot, being supported on the blocks 99, about the main direction of the small bar 89. The actuator 11 can therefore pivot freely relative to the casing 1 about the axis which is delimited by the small transverse bar 89, that is to say, about a horizontal axis parallel with the lateral walls 23.

The closing plate 13 closes the open upper face of the casing 1, whilst retaining the previously described elements, that is to say, the domes 3, 5, the membrane 7, the push-button 9 and the actuator 11, in their operating position inside the casing. The closing plate 13 is arranged horizontally on the casing 1. It comprises elements for hooking onto the casing, such as a pair of straps 101, which extend substantially vertically, and hooking tongues 103 which engage in complementary slots 105 of the casing 1. It also comprises a vertical strip 107 for closing the notch 47.

The closing plate 13 is preferably of stainless steel.

The operation of the switch will now be described starting from the rest position thereof illustrated in FIG. 3.

Firstly, the activation axis will be defined as being the sliding axis of the push-button 9, that is to say, the X axis, and the axis of deformation as being the preferred axis along which the domes 3, 5 can be urged and resiliently deformed, that is to say, the vertical axis Z.

As previously mentioned, when the switch is in this position, the push-button 9 is in its position of maximum withdrawal from the casing 1. The cam surface 83 thereof comes into contact with the cam follower 91 of the actuator 11 which is supported, by means of the stud 93, on the membrane 7 which is itself in contact with the second dome 5. In this configuration, the domes 3, 5 are in the rest state thereof and are not in contact with each other. The first dome 3 forms an electrical contact only with the first track 31, whilst the second dome 5 forms an electrical contact only with the third track 34.

The switch in the rest position is therefore in a first state of commutation.

From this position, when a user presses on the support surface 75 of the push-button 9, the push-button 9 is displaced along the activation axis X. The cam 83 activates the cam follower 91 in such a manner that the push-button 9 sliding along the axis X brings about the rotation of the actuator 11 about the axis of the small bar 89. The stud 93 consequently applies a pressure, substantially along axis Z which is orientated towards the base, to the membrane 7 and the second dome 5. At first, only the second dome 5 deforms with the membrane 7.

At the end of a first sliding path of the push-button 9, which corresponds to a first stage of deformation of the second dome 5, the dome 5 comes into contact, via the peripheral edges of the hole 63 thereof, with the first dome 3 which is still in the rest position.

In this manner, at the end of this first path of the pushbutton, a second commutation state is reached in which the first track 31 and the third track 34 are electrically connected by means of the two domes 3, 5. In this configuration, the second track 27 remains electrically insulated from the other two owing to the fact that the first dome 3 extends above it without any contact.

When he continues to press on the push-button 9, the user depresses the push-button further into the casing, which brings about the continuation of the deformation of the second dome 5 under the action of the pressure of the stud 93, The first dome 3 is then also deformed as well as the second dome 5. The user then senses an increase in mechanical resistance to the push-button being depressed. The switch is then maintained in the second commutation state thereof.

At the end of this second sliding path of the push-button, the two domes 3, 5 reach their configuration of maximum deformation, in which the central portion of the first dome 3 comes into contact with the conductive contact element 27.

A third state of commutation is therefore achieved, in which the three conductive tracks 27, 31, 34 are electrically connected: the first track 31 and the second track 27 are electrically connected to each other by means of the first dome 3; and the first track 31 and the third track 34 are electrically connected to each other by means of the domes 3, 5.

Owing to the central hole 63 which is arranged in the second dome 5, an annular contact surface is obtained, over a relatively large surface, between the two domes. This arrangement allows two of the three tracks to be connected in a reliable manner in the second and third states of commutation. It can be seen that the central hole 63 has a minimal horizontal diameter that is at least as large as the dome horizontal width parallel to the activation axis X.

Starting from this third state of commutation, when the user releases the pressure on the push-button 9, the domes 3, 5 again assume their rest state by means of resilient return, with the push-button 9 and the actuator 11 being returned to their initial rest state.

The switch then returns to the first commutation state thereof in which the three tracks 27, 31, 34 are electrically insulated.

Owing to the invention described above, a so-called lateral activation switch has been produced, that is to say, having a perpendicular activation axis and deformation axis, three electrical tracks to be commutated and three states of commutation.

The novel features of the invention are set forth with particularity in the appended claims. The invention will be best understood from the following description when read in conjunction with the accompanying drawings.

What is claimed is:

1. An electrical switch comprising a casing (1) having a base(21), first, second and third conductive tracks (31, 27, 34) on said base, and first and second conductive domes (3, 5) supported on the base and in contact, respectively, with said first and third tracks (31, 34), the domes being initially out of engagement with each other, the second dome (5) being downwardly depressable against the first dome (3) and the first dome being downwardly depressable against said second contact (27), wherein:

said base has a lower surface with said first track (31) lying threreat, and said base has a raised surface lying above said lower surface with said third track (34) lying thereat;

said first dome (3) has opposite first edges (51) spaced apart by a first length, said opposite first edges lying on said lower surface and one of said first edges lies on said first track (31);

said second dome (5) has opposite second edges (57) spaced apart by a second length that is greater than said first length, said opposite second edges lying on said raised surface and one of said second edges lying on said second track (34).

2. The switch described in claim 1 wherein:

said first conductive track (31) lies at only one first side of said casing to engage only one corresponding side of said first dome, and said third conductive track (34) lies at only one second side of said casing which is opposite said first side to engage only one corresponding side of said second dome, whereby to widely separate the first and third tracks.

3. The switch described in claim 1 including:

said second contact (27) lies under a middle of said first dome (3);

said second dome has a center hole (63) with hole edge walls that receive a middle of said first dome (3) when the second dome is depressed.

4. The switch described in claim 3 wherein:

said second contact (27) has a horizontal diameter, and said hole (63) in said second dome has a greater diameter than the diameter of said second contact (27).

5. The switch described in claim 1 including a membrane lying over said second dome, and an activation device that includes an operation element (9) mounted in the casing to slide in a first horizontal direction, and a movement transformation element (11) with a part (91) lying in the path of said operation element, and having a part (93) positioned to move down, wherein:

said movement transformation element is a rigid element that has a pair of ends (95) spaced apart in a second horizontal direction, and said case forms a pair of recesses (97) that loosely receive said element ends that allow said second element ends to pivot about an axis that extends in said second horizontal direction, whereby to minimize the force required to depress said membrane and said first and second domes.

6. An electrical switch comprising a casing (1) having a base (21), first, second and third conductive tracks (31, 27, 34) fixed to the casing, first and second resilient conductive domes (3, 5) that are initially out of contact with each other that are each supported on the base (21) and in contact respectively with the first and second tracks (31, 34), said second dome having a middle portion lying over the first dome and being downwardly deflectable to contact the first dome and deflect the first dome down against said second conductive track (27), and an actuator (11) that can downwardly deflect the second dome, wherein:

said second dome (5) has a middle with a hole (63), the hole having hole edges positioned to receive and engage the first dome (3) to depress it when the first dome is depressed.

7. The switch described in claim 6 wherein:

said second dome has a horizontal width in a first direction (X) and has a horizontal length that is at least as large as said horizontal width, and said hole has a horizontal diameter that is at least half of said horizontal width.

8. The switch described in claim 6 wherein:

said second contact (27) has a horizontal diameter, and said hole (63) in said second home has a greater diameter than the diameter of said second contact.

9. The switch described in claim 6 wherein:

said base has a lower surface with said first track (31) lying threreat, and said base has a raised surface lying above said lower surface with said third track (34) lying thereat;

said first dome (3) has opposite first edges (51) spaced apart by a first length, said opposite first edges lying on said lower surface and one of said first edges lies on said first contact (31);

said second dome (5) has opposite second edges (57) spaced apart by a second length that is greater than said first length, said opposite second edges lying on said raised surface and one of said second edges lying on said second contact (34).

* * * * *